US008333644B2

(12) United States Patent
Solaja et al.

(10) Patent No.: US 8,333,644 B2
(45) Date of Patent: Dec. 18, 2012

(54) METHOD OF GAMING AND GAMING SYSTEM

(75) Inventors: Zenja Solaja, Maribyrnong (AU); Daniel Julio Montenegro, Endevour Hills (AU)

(73) Assignee: Aristocrat Technology Australia Pty Limited (AU)

( * ) Notice: Subject to any disclaimer, the term of this patent is extended or adjusted under 35 U.S.C. 154(b) by 1096 days.

(21) Appl. No.: 12/176,019

(22) Filed: Jul. 18, 2008

(65) Prior Publication Data

US 2009/0149237 A1 Jun. 11, 2009

(30) Foreign Application Priority Data

Jul. 20, 2007 (AU) ..... 2007903938

(51) Int. Cl.
*A63F 9/24* (2006.01)

(52) U.S. Cl. ..... 463/11

(58) Field of Classification Search ..... 463/16, 463/20, 25, 11
See application file for complete search history.

(56) References Cited

U.S. PATENT DOCUMENTS

| | | | | |
|---|---|---|---|---|
| 4,740,185 | A | 4/1988 | Inglee | |
| 6,241,607 | B1 * | 6/2001 | Payne et al. | 463/20 |
| 6,277,025 | B1 * | 8/2001 | Margolin | 463/18 |
| 6,322,445 | B1 * | 11/2001 | Miller | 463/13 |
| 6,644,666 | B1 * | 11/2003 | Tamura et al. | 273/292 |
| 7,431,645 | B2 * | 10/2008 | Han et al. | 463/16 |
| 7,438,639 | B2 * | 10/2008 | Osawa | 463/20 |
| 2003/0100356 | A1 * | 5/2003 | Brown et al. | 463/9 |
| 2003/0104855 | A1 * | 6/2003 | McClintic | 463/16 |
| 2004/0038727 | A1 * | 2/2004 | Aida | 463/20 |
| 2004/0166929 | A1 * | 8/2004 | Tarantino | 463/22 |
| 2005/0051954 | A1 | 3/2005 | Scott et al. | |
| 2007/0082728 | A1 * | 4/2007 | Wilkins et al. | 463/22 |
| 2008/0157471 | A1 * | 7/2008 | Darling | 273/292 |

FOREIGN PATENT DOCUMENTS

| | | |
|---|---|---|
| CA | 2562324 | 5/2007 |
| GB | 513068 | 10/1939 |
| WO | WO 2007084766 A2 * | 7/2007 |
| WO | 2007142897 A2 | 12/2007 |
| WO | 2007142897 A3 | 12/2007 |
| WO | 2008157837 A1 | 12/2008 |

* cited by examiner

*Primary Examiner* — William Brewster
*Assistant Examiner* — Jason Skaarup
(74) *Attorney, Agent, or Firm* — McAndrews, Held & Malloy, Ltd.

(57) ABSTRACT

A method of gaming comprising: selecting a plurality of groups of at least two symbols for a play line played by a player; displaying the selected groups at respective ones of a plurality of display positions on the play line; linking groups of symbols based on at least one symbol linking rule; and awarding a prize to the player if sufficient of the groups of symbols on the play line have been linked.

44 Claims, 8 Drawing Sheets

METHOD OF GAMING AND GAMING SYSTEM

RELATED APPLICATIONS

This application claims priority to and benefit of Australian Patent Application No. 2007903938, filed Jul. 20, 2007, entitled "A Method of Gaming and Gaming System", which is incorporated herein by reference in its entirety.

The present invention relates to a method of gaming and a gaming system.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The games played on gaming machines vary from market to market. Reasons for variation in games include regulations within the market or the appeal that particular games have within a market. For example, in some markets, slot machines with spinning reel games are popular whereas in other markets gaming machines which allow players to play games like bingo or poker are popular.

There is a need to provide a game that may have appeal in some markets.

BRIEF SUMMARY OF THE INVENTION

In a first aspect the invention provides a method of gaming comprising:

selecting a plurality of groups of at least two symbols for a play line played by a player;

displaying the selected groups at respective ones of a plurality of display positions on the play line;

linking groups of symbols based on at least one symbol linking rule; and awarding a prize to the player if sufficient of the groups of symbols on the play line have been linked.

In an embodiment, the step of linking is performed automatically.

In an embodiment, the step of linking is performed by the player.

In an embodiment, at least one symbol linking rule specifies that a symbol of a group may only be linked to one symbol of another group.

In an embodiment, at least one symbol linking rule specifies that that a symbol of a group may be linked to a symbol of another group by matching the symbols.

In an embodiment, at least one symbol linking rule specifies that that a wild symbol matches any other symbol.

In an embodiment, each group of symbols is displayed as a token.

In an embodiment, the method comprises selecting the plurality of groups of at least two symbols by selecting a plurality of tokens.

In an embodiment, each group of symbols consists of two symbols.

In an embodiment, the method comprises receiving a player selection of at least one play line of a plurality of play lines.

In an embodiment, the method comprises carrying out the linking step in respect of each selected play line.

In an embodiment, the tokens are dominoes.

In an embodiment, the method comprises revising the display of groups, linking groups of the revised display and awarding a prize to the player if sufficient symbols of the revised display on a play line are linked.

In a second aspect the invention provides a gaming controller for a gaming system, the gaming controller arranged to:

select a plurality of groups of at least two symbols for a play line played by a player;

cause the display of the selected groups at respective ones of a plurality of display positions on the play line on a display;

link groups of symbols based on at least one symbol linking rule; and award a prize to the player if sufficient of the groups of symbols on the play line have been linked.

In an embodiment, the gaming controller is arranged to link groups of symbols automatically.

In an embodiment, the gaming controller is arranged to link groups of symbols in response to at least one instruction received from the player.

In an embodiment, at least one symbol linking rule specifies that a symbol of a group may only be linked to one symbol of another group.

In an embodiment, at least one symbol linking rule specifies that that a symbol of a group may be linked to a symbol of another group by matching the symbols.

In an embodiment, at least one symbol linking rule specifies that that a wild symbol matches any other symbol.

In an embodiment, each group of symbols is displayed as a token.

In an embodiment, the gaming controller comprises a token selector arranged to select the plurality of groups of at least two symbols by selecting a plurality of tokens.

In an embodiment, each group of symbols consists of two symbols.

In an embodiment, the gaming controller is arranged to receive a player selection of at least one play line of a plurality of play lines.

In an embodiment, the gaming controller is arranged to link groups of symbols in respect of each selected play line.

In an embodiment, the tokens are dominoes.

In an embodiment, the gaming controller is further arranged to revise the display of groups, link groups of the revised display and award prize to the player if sufficient symbols of the revised display on a play line played by the player are linked.

In an embodiment, the gaming controller comprises a token linker for linking the tokens.

In an embodiment, the gaming controller comprises an outcome determiner arranged to determine whether to award a prize.

In a third aspect the invention provides a gaming system comprising:

a display; and a game controller arranged to:

select a plurality of groups of at least two symbols for a play line played by a player;

display the selected groups at respective ones of a plurality of display positions on the play line on the display;

link groups of symbols based on at least one symbol linking rule; and award a prize to the player if sufficient of the groups of symbols on the play line have been linked.

In an embodiment, the game controller is arranged to link groups of symbols automatically.

In an embodiment, the game controller is arranged to link groups of symbols in response to at least one link instruction received from the player.

In an embodiment, at least one symbol linking rule specifies that a symbol of a group may only be linked to one symbol of another group.

In an embodiment, at least one symbol linking rule specifies that that a symbol of a group may be linked to a symbol of another group by matching the symbols.

In an embodiment, at least one symbol linking rule specifies that that a wild symbol matches any other symbol.

In an embodiment, each group of symbols is displayed as a token.

In an embodiment, the game controller comprises a token selector arranged to select the plurality of groups of at least two symbols by selecting a plurality of tokens.

In an embodiment, each group of symbols consists of two symbols.

In an embodiment, the game controller is arranged to receive a player selection of at least one play line of a plurality of play lines.

In an embodiment, the game controller is arranged to link groups of symbols in respect of each selected play line.

In an embodiment, the tokens are dominoes.

In an embodiment, the game controller is arranged to revise the display of groups, link groups of the revised display and award prize to the player if sufficient symbols of the revised display on a play line played by the player are linked.

In an embodiment, the game controller comprises a token linker for linking the tokens.

In an embodiment, the game controller comprises an outcome determiner arranged to determine whether to award a prize.

In an embodiment, the gaming system comprises a link instruction input mechanism to enable the player to input at least one link instruction.

In a fourth aspect the invention provides a computer program code which when executed by a processor implements the above method of gaming.

In a fifth aspect the invention provides a computer readable medium comprising the above program code.

In a sixth aspect the invention provides a data signal comprising the above program code.

In a seventh aspect, the invention extends to transmitting the above program code.

DETAILED DESCRIPTION OF THE INVENTION

Figure 1:
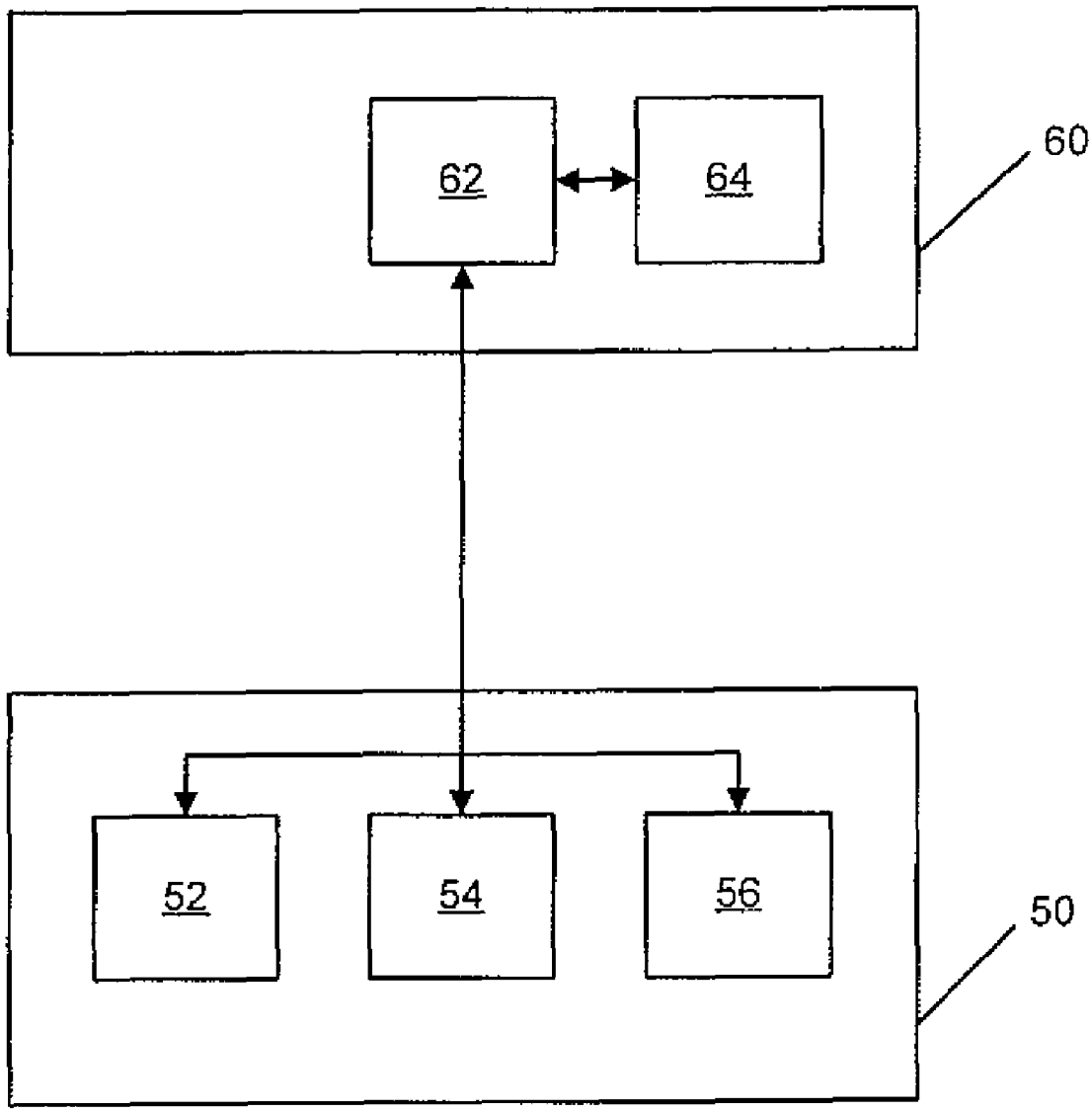
FIG. 1 is a block diagram of the core components of a gaming system.

Referring to the drawings, there is shown a gaming system arranged to implement a symbol linking game, exemplified by a domino game In the domino game, dominoes are selected and arranged on play lines. The gaming system then determines which dominoes may be linked and awards prizes for linked dominoes on player played play lines. The gaming system can take a number of different forms.

In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system has several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions and play the game.

Components of the player interface may vary from embodiment to embodiment but will typically include a credit mechanism 52 to enable a player to input credits and receive payouts, one or more displays 54 and a game play mechanism 56 that enables a player to input game play instructions.

The game controller 60 is in data communication with the player interface and typically includes a processor 62 that processes the game play instructions in accordance with game play rules and outputs game play outcomes to the display. Typically, the game play instructions are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server.

Figure 2:
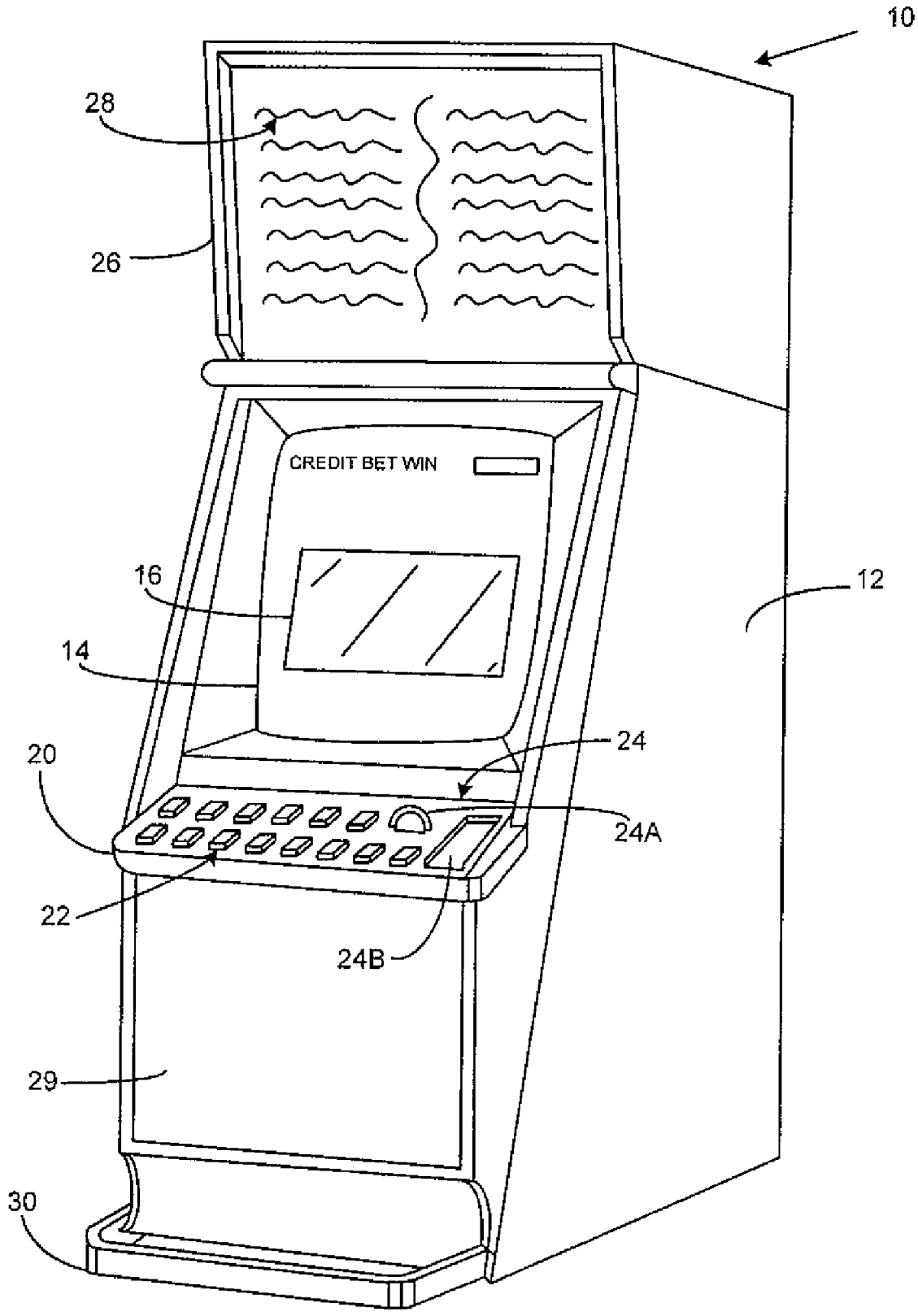
FIG. 2 is a perspective view of a stand alone gaming machine.

A gaming system in the form of a stand alone gaming machine 10 is illustrated in FIG. 2. The gaming machine 10 includes a console 12 having a display 14 on which is displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. A reading device may also be provided for the purpose of reading a player tracking device, for example as part of a loyalty program. The player tracking device may be in the form of a card, flash drive or any other portable storage medium capable of being read by the reading device.

A top box 26 may carry artwork 28, including for example play tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
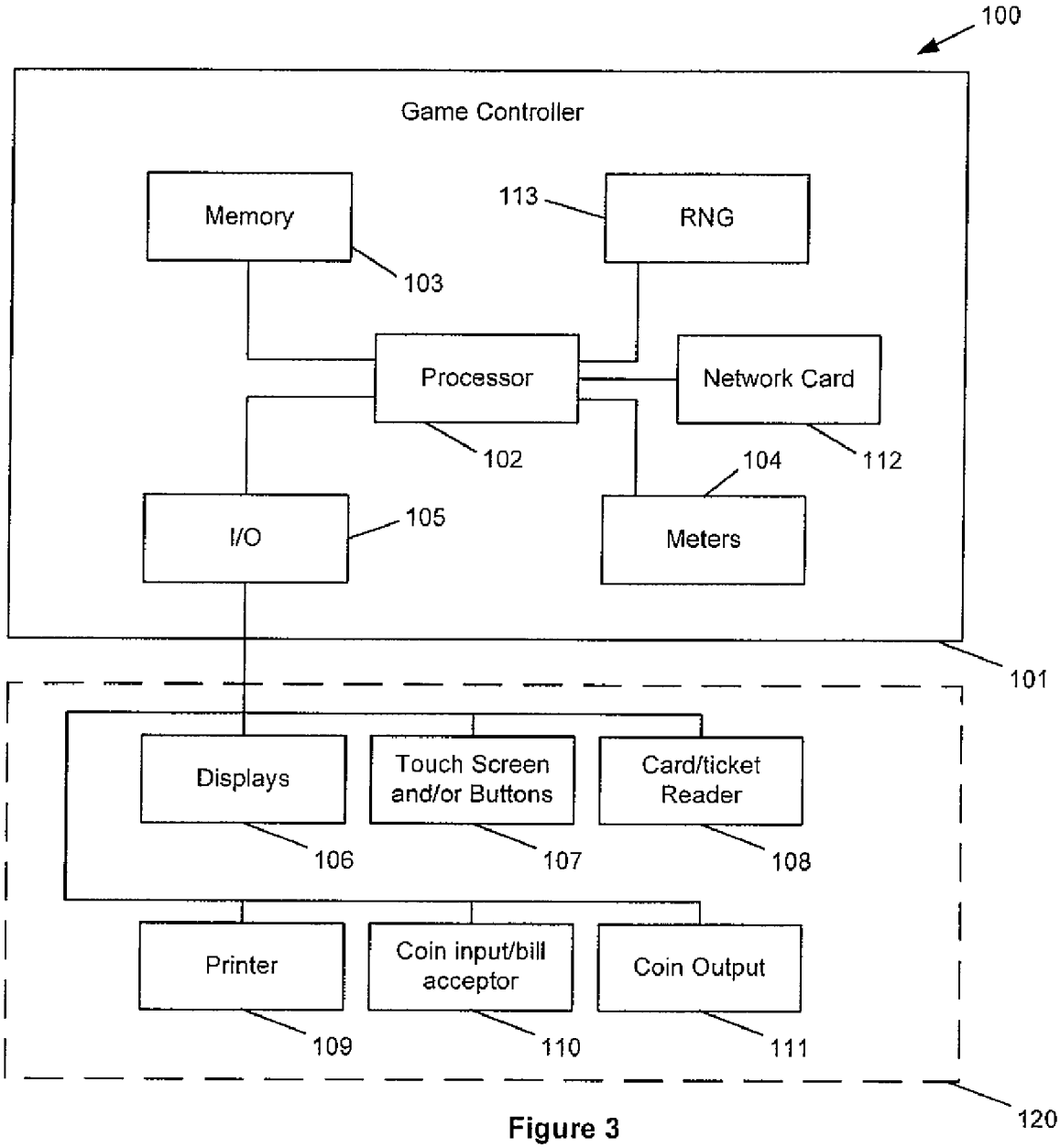
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 include one or more displays 106, a touch screen and/or buttons 107, a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation.

In addition, the gaming machine 100 may include a communications interface, for example a network card 112. The network card may, for example, send status information, accounting information or other information to a central controller, server or database and receive data or commands from the central controller, server or database.

Figure 4:
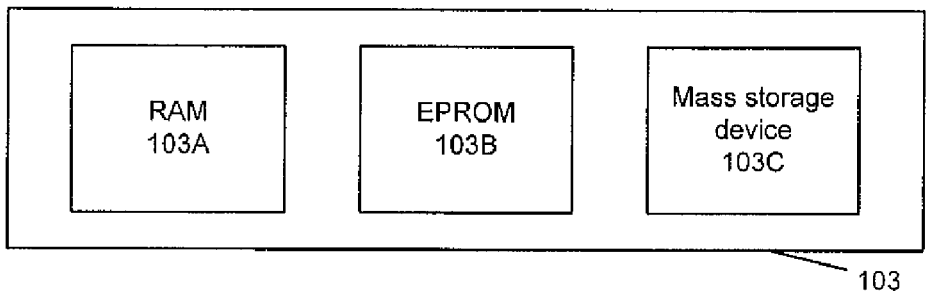
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106, 107, 108, 109, 110, 111 to be provided remotely from the game controller 101.

Figure 5:
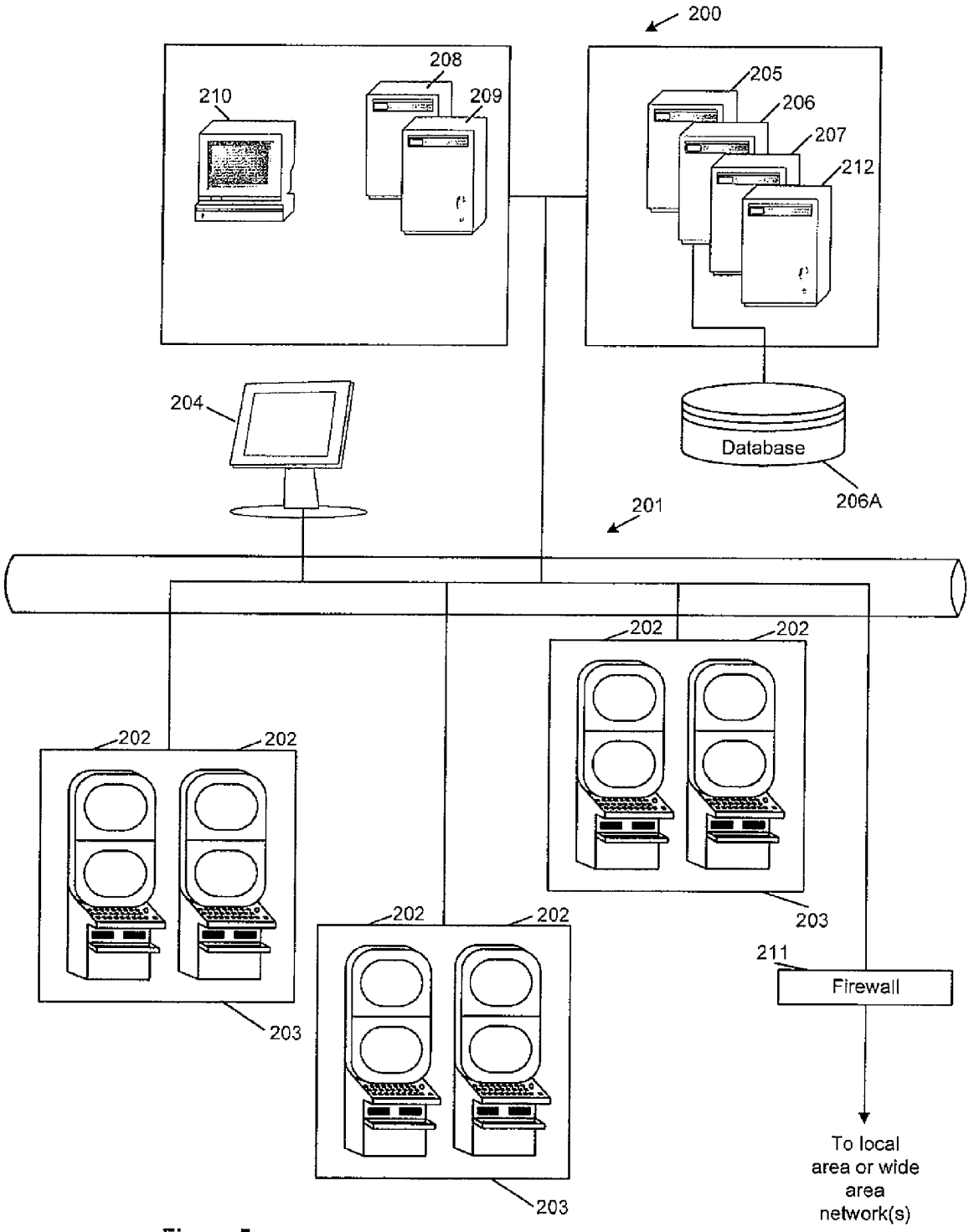
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to implement the accounting functions of a Jackpot game. The system may also include a player loyalty system 212.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming network 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of games servers could be provided to run different games or a single game server may run a plurality of different games as required by the terminals.

Figure 6:
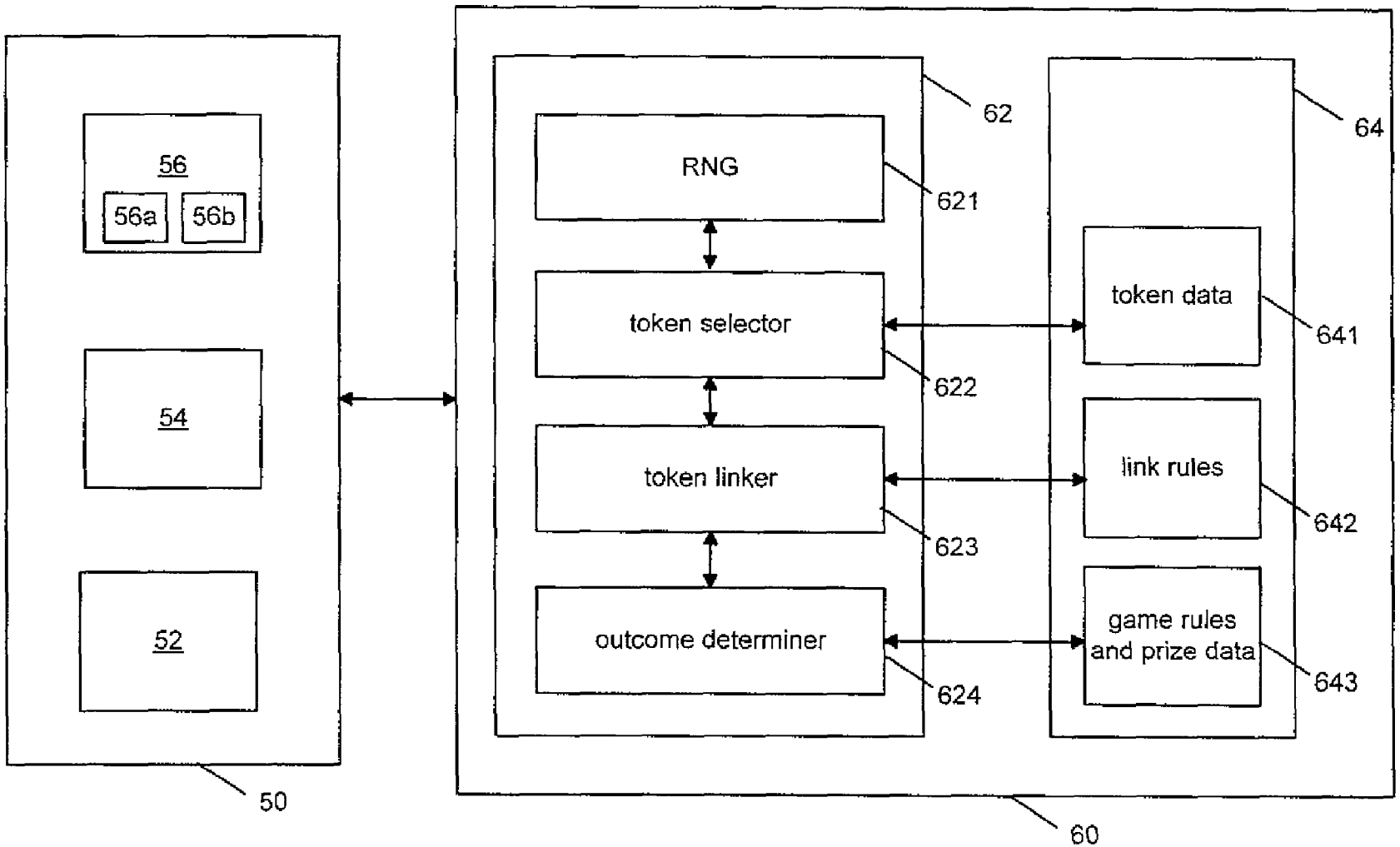
FIG. 6 is a block diagram showing further details of the opponents of a gaming system.

Referring to FIG. 6 there is a shown a block diagram containing more detail than FIG. 1. The instruction input mechanism 56 includes a play line selector 56*a* which enables the player to select how many play lines they will play and a bet amount selector 56*b* operable by the player to select the amount of credits they wish to bet per play line. The game controller 60 implements a number of separate modules 621 to 624 to carry out various functions in respect of the game. In the embodiment these modules 621 to 624 are implemented as software program code executed by processor 62. However, a person skilled in the art will appreciate that some or all of the modules 621 to 624 may be implemented as dedicated hardware components. For example, it is possible to provide a dedicated random number generator module 621.

A person skilled will appreciate that other symbols, for example card symbols animal symbols or other identifiers as can be used. The number of different symbols can be used to vary the domino distribution. Further, while the embodiment employs dominoes having a predetermined two symbols thereon. In some embodiments, it may be desirable to select symbols at random from a set of symbols to form the dominoes—i.e. by randomly selecting two symbols to form each domino rather than selecting dominoes. Thus, a domino may be understood to be a group of two symbols displayed on a token. A person skilled in the art will appreciate that other forms of tokens may be used to for example, tokens having three symbols or more thereon.

Figure 8:
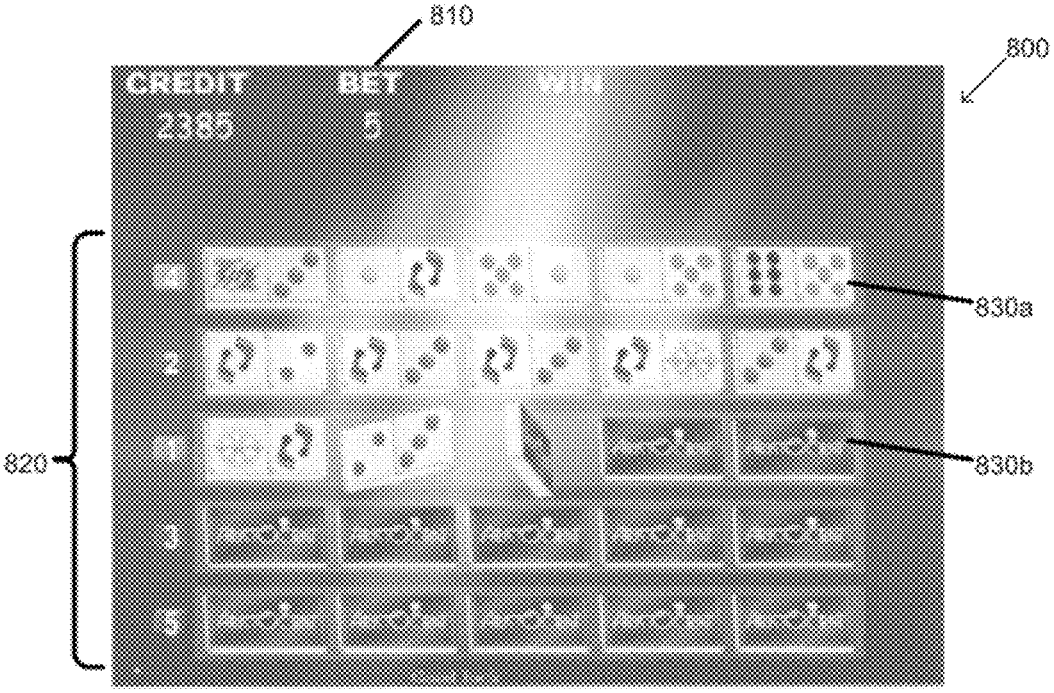
FIGS. 8 to 10 are screen shots of a domino game of the embodiment.
Figure 9:
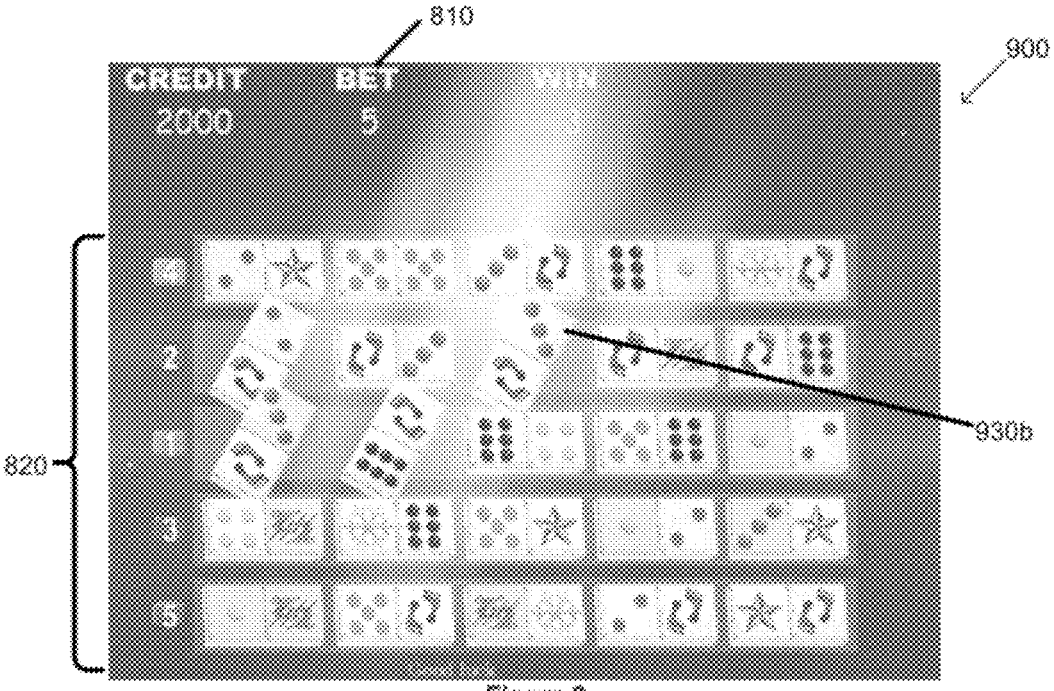
Figure 10:
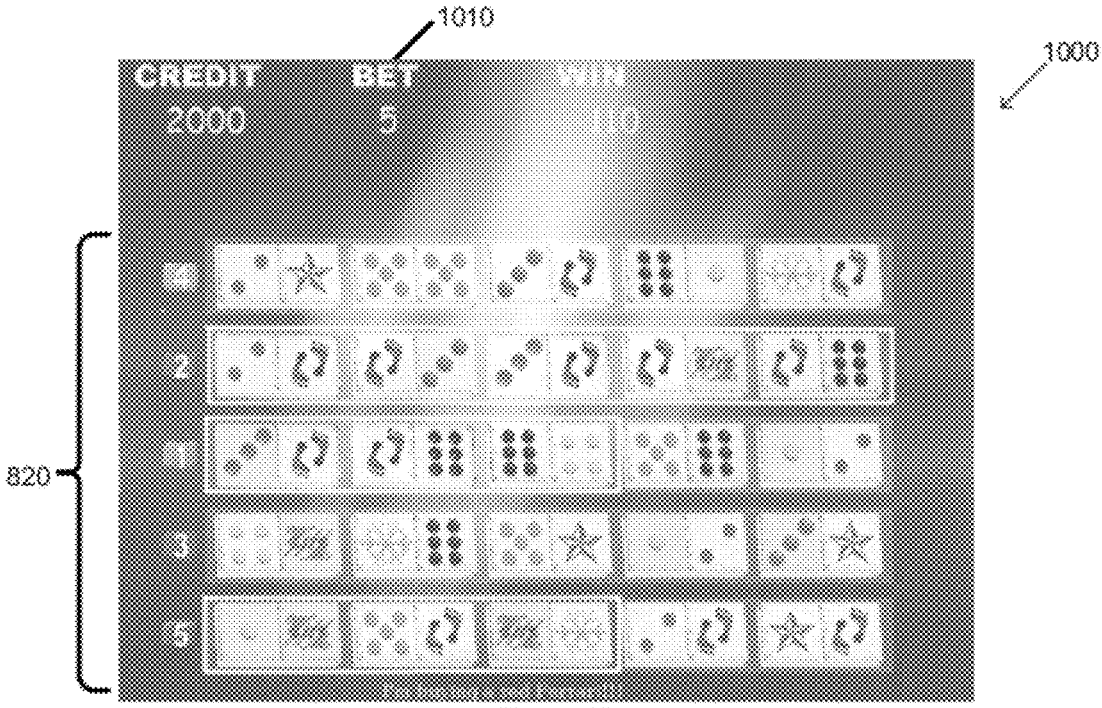

In the embodiment, the token selector randomly selects dominoes using random number generator 621 from a set of dominoes and displays them as shown in FIGS. 8 to 10 in a 5×5 grid.

In accordance with the invention, prizes are awarded for linking dominoes on the play lines that a player is playing. Accordingly, the game controller includes a token linker 623 arranged to determine how the dominoes may be linked based on link rules 642.

In an alternative embodiment, the player operates the instruction input mechanism 56 to in put one or more link instructions to thereby make selections as to how the dominoes should be linked and the token linker 623 determines whether the attempted links are correct in accordance with the link rule. For example, where the input mechanism 56 includes a touch screen, the player could touch each domino which the player wants to rotate.

The outcome determiner 624 then determines whether to award a prize based on the linked dominoes in accordance with the game rule and prize data 641. In some embodiments, dominoes having higher ranked identifiers for example a larger number of dots on their faces can be used as the basis of awarding a higher prize. A set of dominoes may also include dominoes that allow links to be made even when there is not a match or which are treated deemed a match such as a wild symbol.

Further, in the example described below the dominoes are linked in play lines defined by rows in the matrix. However a person skilled in the art will appreciate that play lines can be defined in a number of different ways.

In other embodiments, one or more dominoes may be moved in accordance with game rules in order to form additional links. For example, either a single domino or a row or column of dominoes may be moved in accordance with game rules.

In a further embodiment, there may be additional dominoes, for example, displayed in a reserve area which are used to replace dominoes to form links. In accordance with techniques known in the art, some of these possible additional features may be available to players who place additional bets or may be awarded based on an earlier game outcome.

Figure 7:
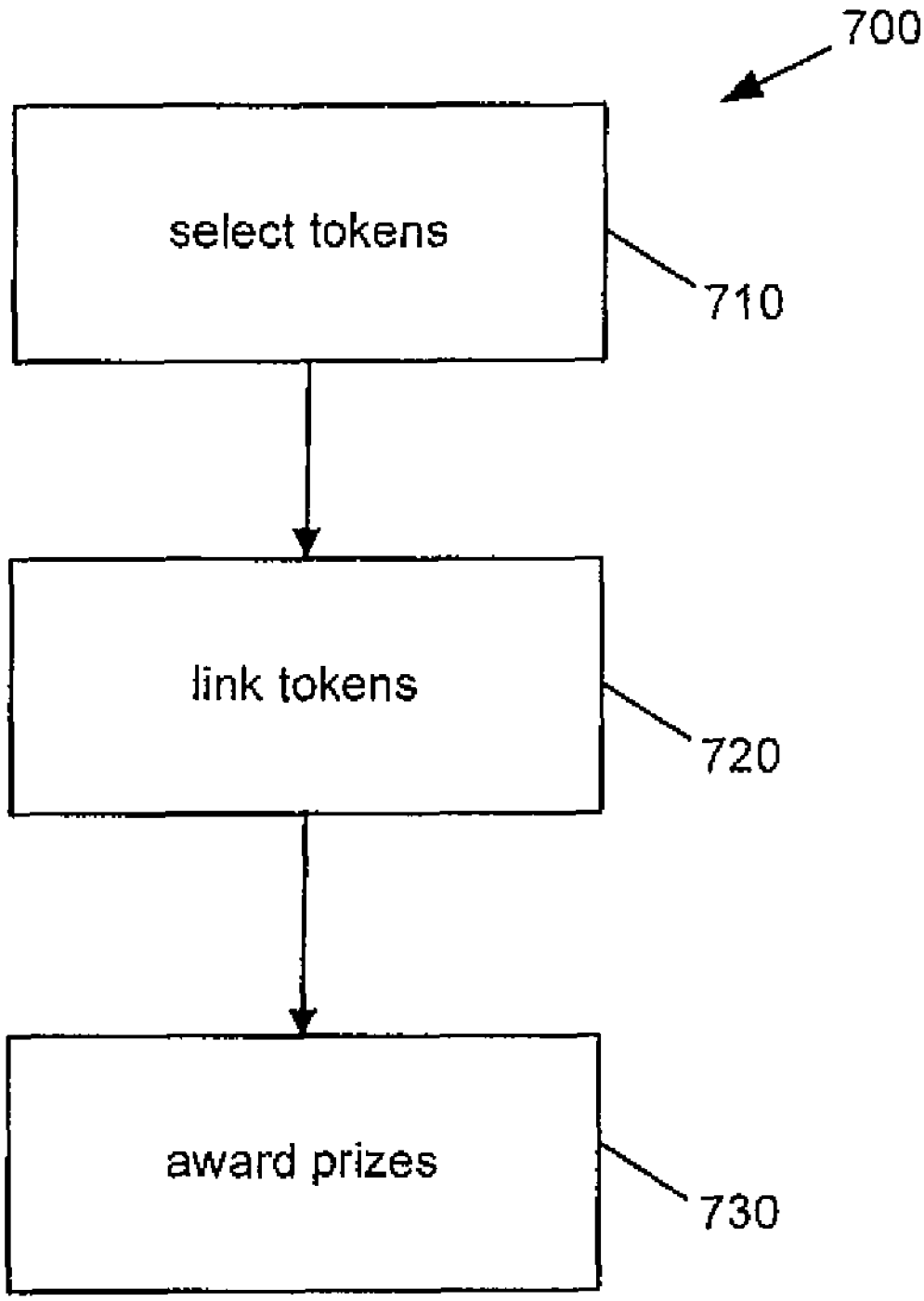
FIG. 7 is a flowchart of a method of an embodiment.

The process 700 of the embodiment is shown in FIG. 7. The process 700 involves selecting tokens 710, linking the tokens 720 and awarding prizes based on the link 730.

Persons skilled in the art will also appreciate that the method of the embodiment could be embodied in program code. The program code could be supplied in a number of ways, for example on a computer readable medium, such as a disc or a memory (for example, that could replace part of memory 103) or as a data signal (for example, by downloading it from a server).

The number of dominoes that a player is required to link will depend on the game rules 641 that is the game rules and prize data will specify how many symbols are sufficient for a prize to be awarded. For example, in some embodiments linking two tokens may not sufficient.

The display of a game may be carried out in a number of different ways. In some embodiments if the player selects to play only one play line, only tokens corresponding to that play line are drawn and displayed on the display. In a typical embodiment, a grid of dominoes is shown face down so that the symbols are not visible prior to the player playing the game. After the player chooses the number of play lines to cover and enters their bet amount, the dominoes are turned over (preferably with animation) to reveal the symbols. In some embodiments, only dominoes played by the player are turned over. In a similar manner, in some embodiments the linking operation may only be performed on paid for play lines or alternatively may be highlighted to distinguish it from linking operations occurring on play lines not played by the player.

Persons skilled in the art will appreciate that other grid configurations may be employed, for example, 3×5, 4×5, 5×6 etc.

Various modifications to the above embodiment will apparent to a person skilled in the art and should be considered as falling within the scope of the invention described herein.

EXAMPLE

To commence play, the player employs game play mechanism 56 in the form of a touch screen or buttons 107 to choose a bet multiplier and choose play lines to play in a manner analogous to a multi-line reel spinning game. A new set of dominoes are selected and arranged in a grid of 5 columns and 5 rows as shown in FIG. 8. This is done by turning over a set of dominoes that are face down, such as domino 830*b* to a series of face up dominoes 830*a* as shown in the screen shot 800 of FIG. 8. It will also be apparent from FIG. 8 that there are five play lines 820 as well as a display of the credit bet and win amounts 810. In the example, once the whole stack is revealed dominoes such as domino 930*a* are turned to form winning combinations. The screen shot 900 of FIG. 9 shows the dominoes being linked by turning them to form the optimum matching sequence. In an embodiment, dominoes are only displayed for selected play lines.

FIG. 10 shows the final result wherein play line 2 plays for 5 dominoes as the wild symbol in the fourth column connects to the footprint symbol in the fifth column. Play line 1 plays for 3 dominoes, play line 3 pays for 2 dominoes with a connect using a wild symbol and play line 5 pays for 3 dominoes with a wild connecting again.

It will be understood to persons skilled in the art of the invention that many modifications may be made without departing from the spirit and scope of the invention, in particular it will be apparent that certain features of embodiments and examples of the invention can be employed to form further embodiments.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A method of gaming for use with a gaming machine having a game controller and a display, the method comprising:

selecting via the game controller a plurality of groups of at least two symbols for a play line played by a player;

displaying on the display the selected groups at respective ones of a plurality of display positions on the play line;

determining via the game controller an optimum matching sequence of the symbols;

moving the symbols via the game controller so as to link the groups of symbols based on the optimum matching sequence of the symbols; and awarding via the game controller a prize to the player if sufficient of the groups of symbols on the play line have been linked.

2. A method as claimed in claim 1, and further comprising performing said moving automatically.

3. A method as claimed in claim 1, and further comprising allowing said moving to be performed by the player.

4. A method as claimed in any claim 1, and further comprising specifying a symbol of a group may only be linked to one symbol of another group.

5. A method as claimed in claim 1, and further comprising specifying a symbol of a group may be linked to a symbol of another group by matching the symbols.

6. A method as claimed in claim 5, and further comprising specifying a wild symbol matches any other symbol.

7. A method as claimed in claim 1, and further comprising displaying each group of symbols as a token.

8. A method as claimed in claim 7, and further comprising selecting the plurality of groups of at least two symbols by selecting a plurality of said tokens.

9. A method as claimed in claim 1, and wherein each said group of symbols consists of two symbols.

10. A method as claimed in claim 1, and further comprising receiving a player selection of at least one play line of a plurality of play lines.

11. A method as claimed in claim 10, and further comprising moving the symbols in respect of each selected play line.

12. A method as claimed in claim 7, and wherein the tokens are dominoes.

13. A method as claimed in claim 1, and further comprising awarding a prize to the player if sufficient symbols of the moved groups on the play line are linked.

14. A gaming controller for a gaming system haying a display, the gaming controller arranged to:

select a plurality of groups of at least two symbols for a play line played by a player;

cause the display of the selected groups at respective ones of a plurality of display positions on the play line on a display;

determine an optimum matching sequence of the symbols;

move the symbols so as to link the groups of symbols based on the optimum matching sequence of the symbols; and award a prize to the player if sufficient of the groups of symbols on the play line have been linked.

15. A gaming controller as claimed in claim 14, and further arranged to link groups of symbols automatically.

16. A gaming controller as claimed in claim 14, and further arranged to link groups of symbols in response to at least one instruction received from the player.

17. A gaming controller as claimed in claim 14, and further arranged to specify a symbol of a group may only be linked to one symbol of another group.

18. A gaming controller as claimed in claim 14, and further arranged to specify a symbol of a group may be linked to a symbol of another group by matching the symbols.

19. A gaming controller as claimed in claim 18, and further arranged to specify a wild symbol matches any other symbol.

20. A gaming controller as claimed in claim 14, and further arranged to cause the display to display each said group of symbols as a token.

21. A gaming controller as claimed in claim 20, and further comprising a token selector arranged to select the plurality of groups of at least two symbols by selecting a plurality of said tokens.

22. A gaming controller as claimed in claim 14, and wherein each said group of symbols consists of two symbols.

23. A gaming controller as claimed in claim 14, and further arranged to receive a player selection of at least one play line of a plurality of play lines.

24. A gaming controller as claimed in claim 23, and further arranged to link groups of symbols in respect of each selected play line.

25. A gaming controller as claimed in claim 20, and wherein the tokens are dominoes.

26. A gaming controller as claimed in claim 14, and further arranged to award prize to the player if sufficient symbols of the moved groups on a play line played by the player are linked.

27. A gaming controller as claimed in claim 20, and further comprising a token linker for linking the tokens.

28. A gaming controller as claimed in claim 14, and further comprising an outcome determiner arranged to determine whether to award a prize.

29. A gaming system comprising:

a display; and a game controller arranged to:

select a plurality of groups of at least two symbols for a play line played by a player;

display the selected groups at respective ones of a plurality of display positions on the play line on the display;

determine an optimum matching sequence of the symbols;

move the symbols so as to link the groups of symbols based on the optimum matching sequence of the symbols; and award a prize to the player if sufficient of the groups of symbols on the play line have been linked.

30. A gaming system as claimed in claim 29, and wherein the game controller is further arranged to link groups of symbols automatically.

31. A gaming system as claimed in claim 29, and wherein the game controller is further arranged to link groups of symbols in response to at least one link instruction received from the player.

32. A gaming system as claimed in claim 29, and wherein the game controller is further arranged to specify a symbol of a group may only be linked to one symbol of another group.

33. A gaming system as claimed in claim 29, and wherein the game controller is further arranged to specify a symbol of a group may be linked to a symbol of another group by matching the symbols.

34. A gaming system as claimed in claim 33, and wherein the game controller is further arranged to specify a wild symbol matches any other symbol.

35. A gaming system as claimed in claim 29, and wherein the game controller is further arranged to cause the display to display each said group of symbols as a token.

36. A gaming system as claimed in claim 35, and wherein the game controller comprises a token selector arranged to select the plurality of groups of at least two symbols by selecting a plurality of said tokens.

37. A gaming system as claimed in claim 29, and wherein each group of symbols consists of two symbols.

38. A gaming system as claimed in claim 29, and wherein the game controller is arranged to receive a player selection of at least one play line of a plurality of play lines.

39. A gaming system as claimed in claim 29, and wherein the game controller is arranged to link groups of symbols in respect of each selected play line.

40. A gaming system as claimed in claim 35, wherein the tokens are dominoes.

41. A gaming system as claimed in claim 29, and wherein the game controller is arranged to award prize to the player if sufficient symbols of the moved groups on a play line played by the player are linked.

42. A gaming system as claimed in claim 35, and wherein the game controller comprises a token linker for linking the tokens.

43. A gaming system as claimed in claim 29, and wherein the game controller comprises an outcome determiner arranged to determine whether to award a prize.

44. A gaming system as claimed in claim 31, and further comprising a link instruction input mechanism to enable the player to input at least one link instruction.

* * * * *